US008276656B2

(12) United States Patent
Goodman

(10) Patent No.: US 8,276,656 B2
(45) Date of Patent: Oct. 2, 2012

(54) SYSTEM AND METHOD FOR MITIGATING SHOCK EFFECTS DURING PERFORATING

(75) Inventor: Kenneth R. Goodman, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/962,218

(22) Filed: Dec. 21, 2007

(65) Prior Publication Data

US 2009/0159284 A1 Jun. 25, 2009

(51) Int. Cl.
*E21B 43/11* (2006.01)

(52) U.S. Cl. ..... 166/55.1; 166/297; 175/4.6; 89/1.15; 102/320

(58) Field of Classification Search ..... 175/4.6; 166/55.1, 297; 89/1.15; 102/320
See application file for complete search history.

(56) References Cited

U.S. PATENT DOCUMENTS

| | | | | |
|---|---|---|---|---|
| 3,016,014 | A * | 1/1962 | Lebourg | 175/4.53 |
| 4,961,365 | A | 10/1990 | Rytlewski | |
| 5,095,801 | A | 3/1992 | Lopez de Cardenas | |
| 5,662,178 | A | 9/1997 | Shirley | |
| 5,816,343 | A | 10/1998 | Markel | |
| 5,952,603 | A * | 9/1999 | Parrott | 102/312 |
| 6,125,946 | A | 10/2000 | Chen | |
| 6,173,773 | B1 | 1/2001 | Almaguer | |
| 6,347,673 | B1 | 2/2002 | Dailey | |
| 6,523,449 | B2 | 2/2003 | Fayard | |
| 6,591,911 | B1 | 7/2003 | Markel | |
| 2005/0194181 | A1 * | 9/2005 | Barker et al. | 175/4.55 |
| 2005/0247447 | A1 * | 11/2005 | Spring et al. | 166/55.2 |

FOREIGN PATENT DOCUMENTS

| | | | |
|---|---|---|---|
| GB | 833164 | A | 4/1960 |
| GB | 2350379 | A | 11/2000 |
| GB | 2410785 | A | 10/2005 |
| GB | 2420804 | A | 6/2006 |
| GB | 2430479 | A | 3/2007 |
| WO | 2005093208 | A1 | 10/2005 |

* cited by examiner

*Primary Examiner* — Kenneth L Thompson
*Assistant Examiner* — Yong-Suk Ro
(74) *Attorney, Agent, or Firm* — Chadwick Sullivan; Rodney Warfford; Matthias Abrell

(57) ABSTRACT

A perforating gun, according to one or more aspects of the present disclosure, comprises a loading tube and a plurality of charges mounted in the loading tube with at least a portion of the plurality of charges being tilted relative to an axis of the loading tube. Wherein the plurality of tilted charges are tilted relative to the axis to create a selected reactive dynamic force on the perforating gun to counter a detrimental force on the perforating gun in response to detonation of the plurality of charges.

20 Claims, 3 Drawing Sheets

SYSTEM AND METHOD FOR MITIGATING SHOCK EFFECTS DURING PERFORATING

BACKGROUND

During preparation of a well, a wellbore is drilled and a perforation procedure is carried out to facilitate fluid flow in the surrounding reservoir. The perforation procedure relies on a perforating gun loaded with charges and moved downhole into the wellbore. Once the perforating gun is located proximate the desired reservoir, the charges are ignited to perforate the formation rock that surrounds the wellbore.

The charges are mounted in a "straight" orientation that directs the shot or blast outwardly into the surrounding formation perpendicular to the perforating gun. As a result, ignition of the charges and the resulting controlled explosion creates substantial forces in the perforating gun and other associated, downhole equipment. In fact, the shock induced by the perforating procedure can cause a great deal of damage to the equipment. This potential for damage is most severe when the perforating procedure is carried out with relatively long perforating guns used to form perforations along a substantial region of the wellbore.

SUMMARY

In general, embodiments in the present application provide a system and method by which the detrimental forces created during perforating are mitigated. A perforating gun is provided with charges mounted in a tilted manner so as to mitigate the detrimental forces acting on the perforating gun and other downhole equipment during a perforation procedure. The charges are tilted relative to an axis of the perforating gun, and this eliminates the potential for creating the most severe consequences when the charges are ignited downhole.

BRIEF DESCRIPTION OF THE DRAWINGS

Certain embodiments will hereafter be described with reference to the accompanying drawings, wherein like reference numerals denote like elements, and.

DETAILED DESCRIPTION

In the following description, numerous details are set forth to provide an understanding of embodiments according to the present invention. However, it will be understood by those of ordinary skill in the art that the present invention may be practiced without these details and that numerous variations or modifications from the described embodiments may be possible.

The present application relates to a system and methodology for mitigating shock effects during perforation procedures. The charges used to create perforations and penetrate the formation surrounding a given wellbore are oriented to provide an axial counterbalancing force to the force loads created during perforating. By orienting at least some of the charges with an appropriate axial tilt, the detrimental force loads acting on the perforating gun and other perforating string equipment are reduced.

Figure 1:
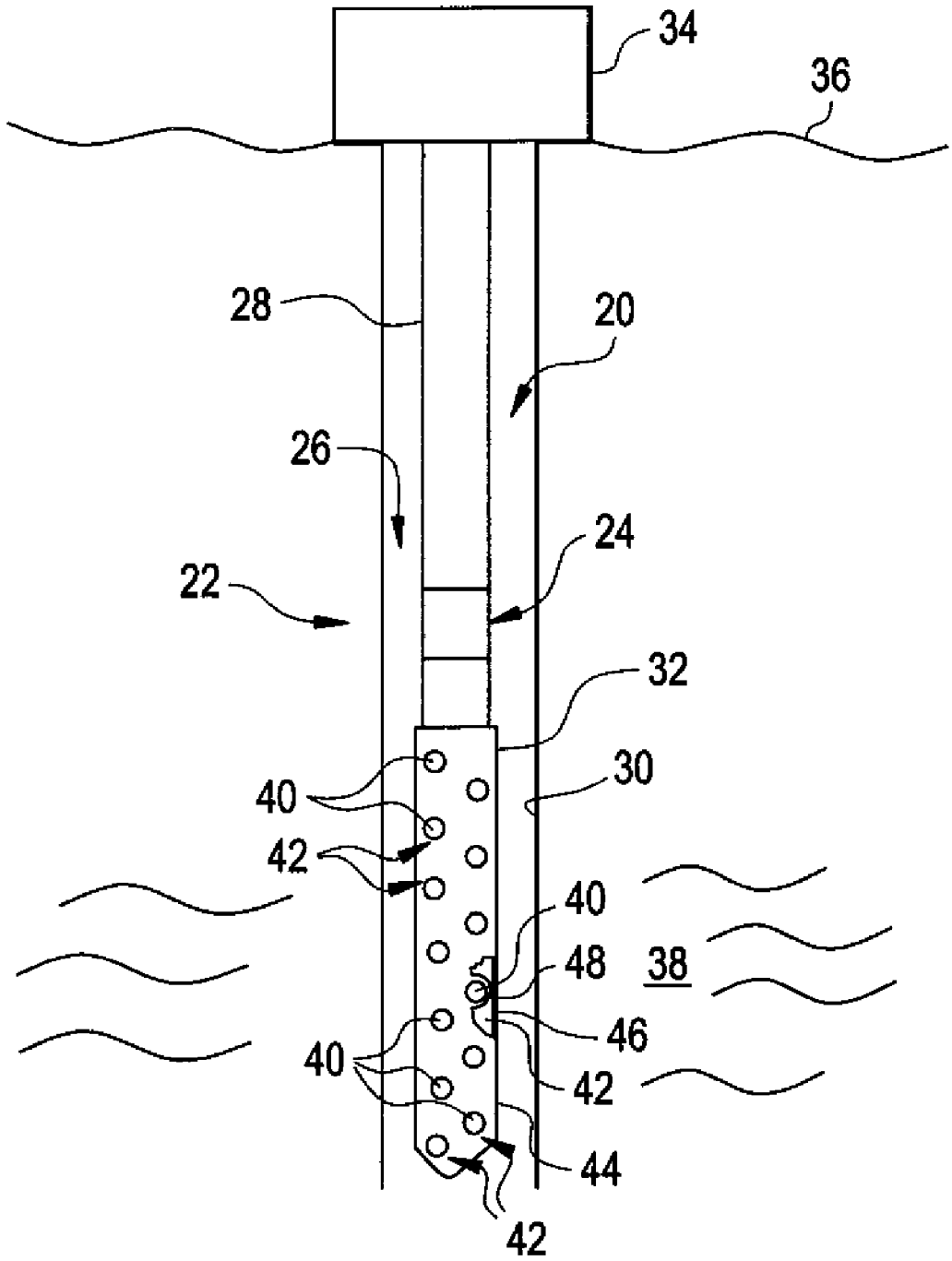
FIG. 1 is a front elevation view of a well perforation system deployed in a wellbore, according to an embodiment.

Referring generally to FIG. 1, one example of a perforating system 20 is illustrated as deployed in a well 22. A perforating string 24 is deployed downhole into a wellbore 26 by an appropriate conveyance 28, which may comprise tubing, wireline, cable or other suitable perforating string conveyances. In the example illustrated, wellbore 26 is lined with a wellbore casing 30.

Perforating string 24 comprises a perforating gun 32 and may comprise a variety of other perforating string components, including gauges, sensors, connectors, and other components that can be utilized in a perforation procedure. The perforating gun 32 is deployed downhole from a wellhead 34 disposed at a surface 36, such as a seabed floor or a surface of the earth. Perforating gun 32 is moved downhole until it is positioned at a desired location within a surrounding formation 38 that is to be perforated.

A plurality of charges 40 are mounted along the perforating gun 32 and directed outwardly toward formation 38. The arrangement of charges 40 can be selected according to the specific perforation procedure anticipated. For example, the number of charges, charge spacing, charge phasing and size of the charges can vary from one application to another. Additionally, the length and diameter of perforating gun 32 can be selected according to the perforating procedure, wellbore size and environment in which the procedure is performed. Regardless of the configuration, the charges 40 are mounted at corresponding charge receptacle sites 42.

The perforating gun 32 can be constructed in a variety of configurations and with a variety of components. As illustrated in the embodiment of FIG. 1, perforating gun 32 comprises an outer housing 44 containing a loading tube 46 (see partially cutaway portion of FIG. 1). Loading tube 46 comprises a plurality of openings or recesses 48 sized to receive charges 40. For example, each charge receptacle site 42 may comprise an opening 48 to receive and orient the corresponding charge 40.

Figure 2:
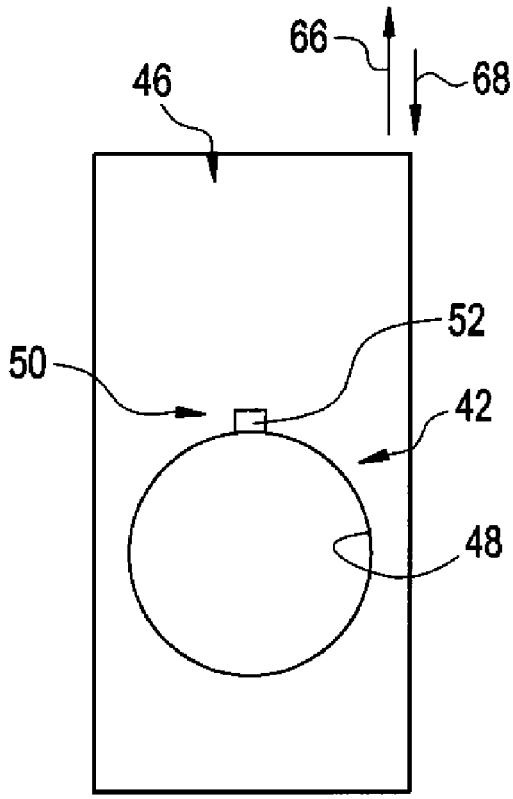
FIG. 2 is a schematic illustration of a portion of a perforating gun loading tube having a charge receptacle site, according to an embodiment.

Referring generally to FIG. 2, a portion of one example of loading tube 46 is illustrated schematically to show one of the charge receptacle sites 42. The charge receptacle site 42 enables a corresponding charge 40 to be mounted with an axial tilt to mitigate the shock effects caused by ignition of the charges 40. In this embodiment, the illustrated charge receptacle site 42 comprises one of the openings or recesses 48 for receiving one of the charges 40. Additionally, the loading tube 46 comprises an orientation feature 50 to position charge 40 at a desired orientation, e.g. at an orientation having an axial tilt. By way of example, orientation feature 50 may comprise an alignment slot 52 extending into loading tube 46 adjacent opening 48. In this example, alignment slot 52 is positioned to orient the corresponding charge 40 with an axial tilt relative to the loading tube 46 and perforating gun 32.

Figure 3:
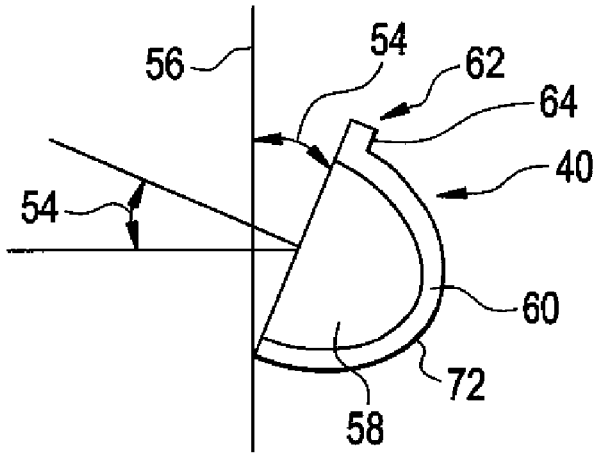
FIG. 3 is a schematic representation of a charge having an axial tilt, according to an embodiment.

The tilted orientation of the charge 40 is better demonstrated by an exaggerated tilt angle 54, as illustrated in FIG. 3. As illustrated, orientation feature 50 can be used to mount each selected charge 40 at an axial tilt in the amount of a desired tilt angle 54 relative to an axis 56 of loading tube 46 and perforating gun 32. In the example illustrated, charge 40 comprises a charge material 58 that is ignitable, and the charge material is held in a charge jacket 60. A corresponding orientation feature 62 is positioned for engagement with orientation feature 50 so that charge 40 is tilted to the desired axial tilt angle when received in opening 48 at mounting site 42. By way of example, corresponding orientation feature 62 comprises an alignment tab 64 that is sized for receipt in alignment slot 52 of loading tube 46.

If all of the charges 40 are straight, i.e. not tilted, during perforation, large detrimental forces are created along loading tube 46 and perforating gun 32, as represented by force arrow 66 (see FIG. 2). However, by tilting a charge or charges 40 at tilt angle 54, a charge reaction force is created during perforation, as represented by charge reaction force arrow 68. This reaction force is initiated by ignition of charges 40 and counters at least a portion of the detrimental force 66 that would otherwise be created upon ignition of the charges 40. Establishing the charge reaction force 68 mitigates the shock and the potentially detrimental effects to loading tube 46, perforating gun 32, and other components of perforating string 24 or associated downhole components.

The size of the charge reaction force 68 generated during a perforation procedure is affected by the tilt angle 54 at which charges 40 are oriented. Additionally, the mitigating reaction force is affected by the length of the perforating gun, the number of charges mounted along the perforating gun, the number of those charges that are oriented with an axial tilt, and the arrangement of those charges along the perforating gun. For example, longer perforating guns typically have more charges that can be used to provide larger reactive forces. In fact, in many applications, a beneficial reaction force or forces can be created with a relatively minimal tilt angle employed by several charges. For example, use of a tilt angle between zero and ten degrees is appropriate in many applications.

Furthermore, the orientation of the charges can be selected to create a variety of different dynamic loads along the length of the perforating gun. For example, the orientation, or the percentage of angled charges, can be adjusted to provide differing dynamic loads at opposite ends of perforating gun 32.

Figure 4:
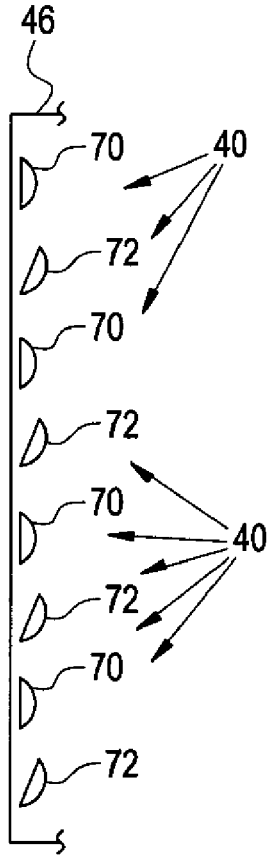
FIG. 4 is a schematic representation illustrating one example for orienting a plurality of charges along a perforating gun, according to an embodiment.
Figure 5:
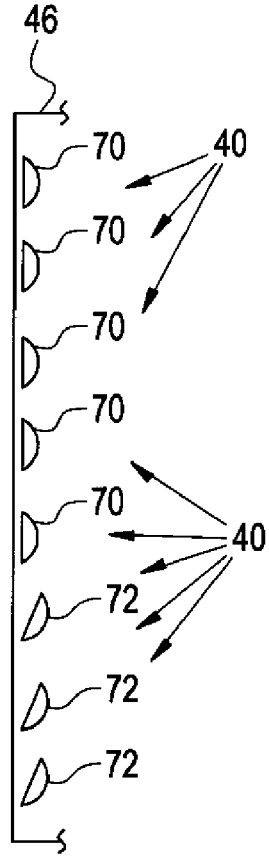
FIG. 5 is a schematic representation illustrating another example for orienting a plurality of charges along a perforating gun, according to an alternate embodiment.
Figure 6:
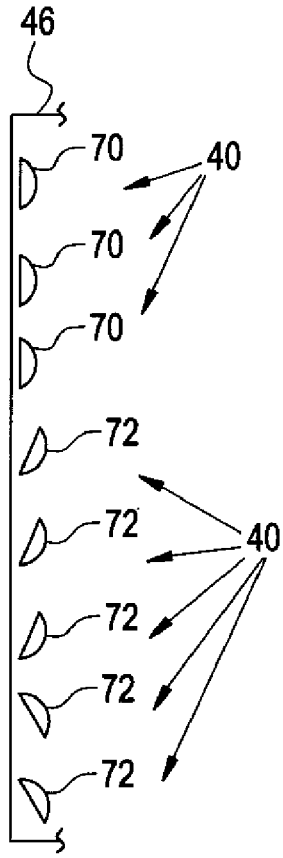
FIG. 6 is a schematic representation illustrating another example for orienting a plurality of charges along a perforating gun, according to an alternate embodiment.

As illustrated in FIGS. 4 through 6, the orientation of the charges 40 can be selected to affect force loading along the perforating gun and associated perforating gun equipment in a variety of ways. As illustrated in FIG. 4, for example, some of the charges 40 can be oriented as straight charges 70 and other charges 40 can be oriented as tilted charges 72 with a desired axial tilt. The mixture of straight charges 70 and tilted charges 72 can be used to reduce detrimental axial force loads incurred by a given perforating gun design. Alternatively, the tilt angle of all charges 40 can be adjusted to achieve the desired reaction force 68 during perforating.

In other applications, the charges 40 can be tilted differently at opposite ends of the perforating gun or at specific regions along the loading tube 46 to create different dynamic loads at different regions along the perforating gun. As illustrated in FIG. 5, for example, tilted charges 72 can be positioned toward one end of the loading tube 46, while charges with a "straight" orientation 70 can be positioned at an opposite end of the loading tube. Alternatively, the charges at opposite ends or at specific regions along the perforating gun can be mounted with different axial tilt angles to achieve desired, differing reaction forces along the perforating gun.

As further illustrated in FIG. 6, the charges 40 also can be oriented with different tilt angles relative to each other. For example, some of the charges 40 can be oriented with a greater tilt angle then other tilted charges. In some applications, the charges can be tilted toward opposed directions, depending on the desired reaction forces 68 that are to be established during the perforating procedure. The number of charges arranged with an actual tilt, the percentage of the charges having an actual tilt, and the angular displacement of the tilted charges can be selected according to a variety of factors. For example, length of the perforating gun, diameter of the perforating gun, strength of perforating gun components, charge size and other factors affect the number, arrangement and tilt of the tilted charges.

A variety of models and calculations can be used to determine tilt angles and charge arrangements, however relatively crude assessments also can be used because many applications do not require an exact counterbalance to the detrimental forces. Even partial reduction of the detrimental loads can create a significant improvement by substantially reducing the potential for damage to the perforating equipment.

In one example, a desired reaction force can be estimated and used to design an appropriate charge arrangement able to create the desired reaction force. For a perforating gun of a given length deployed to a region of the wellbore having a given pressure, the shock that would result from a perforating procedure conducted with straight charges can be determined. The shock/forces create an impulse at the upper end of the perforating gun because the forces are unmatched at the bottom end due to detonation cord delay during ignition of the charges. The undesirable impulse resulting from perforating can be estimated by multiplying the force load by the time delay created by the detonation cord. The calculated impulse is then used to determine the number of charges and the tilt angle of those charges to create a desired reactive force.

In this example, the number of charges used in the perforating gun can be counted, and the momentum for the jet that results from each tilted charge can be estimated by multiplying the average velocity of the jet times the mass of the charge. This momentum value is multiplied by the number of charges that will have an axial tilt to obtain the overall reactive momentum. A desired tilt angle can then be calculated simply by taking the arcsin of the undesirable impulse (that runs axially along the perforating gun) over the collective momentum of the tilted charges (discharged at an axial tilt angle relative to the outward orientation of a "straight" charge). It should be noted that a variety of other methods for estimating or determining the desired angle of tilt relative to the straight orientation can be used. For example, other factors can be utilized in determining actual tilt angles of specific charges to create differing reactive forces at different regions of the perforating gun.

The system and technique for the axial counterbalancing of undesirable force loads and the mitigation of their detrimental effects can be utilized in a variety of perforating systems and applications. Additionally, the type and size of the charges can vary. Furthermore, the arrangement/mixture of axially tilted charges and straight charges can be adjusted according to the specific application and the desired reactive forces. In many applications, all of the charges can be positioned at one or more desired axial tilt angles.

Accordingly, although embodiments have been described in detail above, those of ordinary skill in the art will readily appreciate that many modifications are possible without materially departing from the teachings according to this invention. Accordingly, such modifications are intended to be included within the scope of this invention as defined in the claims.

What is claimed is:

1. A method for perforating a wellbore, comprising:
providing a gun having a vertical axis and a plurality of at least three explosive charges that are mounted adjacent and consecutive to one another;
estimating a detrimental force to be caused by the detonation of the explosive charges in a given wellbore location;
selectively orienting the plurality of explosive charges in the gun relative to the vertical axis of the gun so that the plurality of explosive charges will together generate an axial dynamic force acting downward relative to a surface of the wellbore along the vertical axis of the gun to counteract the estimated detrimental force;
conveying the gun into the wellbore;
detonating the plurality of explosive charges; and
creating the axial dynamic force on the gun in response to detonating the plurality of explosive charges.

2. The method of claim 1, wherein orienting comprises:
orienting tilted explosive charges so that the explosive blast is directed non-perpendicular to the vertical axis; and
orienting straight explosive charges so that the explosive blast is directed perpendicular to the vertical axis.

3. The method of claim 2, comprising orienting the tilted explosive charges at the same non-perpendicular angle relative to the vertical axis.

4. The method of claim 1, wherein the orienting comprises orienting all of the explosive charges to be tilted so that the explosive blast is directed non-perpendicular to the vertical axis.

5. The method of claim 4, wherein the axially tilted charges are oriented at the same non-perpendicular angle relative to the vertical axis.

6. The method of claim 1, further comprising selecting the axial dynamic force to mitigate the detrimental force created at an upper end of the gun due to the time delay in the detonation of the plurality of explosive charges at the upper end perforating gun and the detonation of the plurality of explosive charges proximate a bottom end of the perforating gun.

7. An apparatus for creating perforations in a wellbore, comprising:
a perforating gun;
an upper end portion of the perforating gun;
a bottom end portion of the perforating gun;
a vertical axis of the perforating gun extending between the upper end portion and bottom end portion;
receptacles of the perforating gun positioned between the upper end portion and lower end portion;
shaped charges; and
jacket members configured to receive shaped charges therein and be received in the receptacles of the perforating gun;
an orientation portion of each of the jacket members individually configured to orient the jacket member and shaped charge received therein in a select orientation relative to the vertical axis of the perforating gun to provide a desired reaction force upon detonation of the shaped charge therein.

8. The apparatus of claim 7, wherein the jacket members include tilted jacket members having a orientation portion configured so that the charges positioned within the tilted jacket member are tilted to face downward relative to the vertical axis of the perforating gun.

9. The apparatus of claim 7, wherein the jacket members include straight jacket members having an orientation portion configured so that the charges positioned within the straight jacket member face perpendicular to the vertical axis of the perforating gun.

10. The apparatus of claim 7, wherein the reaction force is selected to mitigate a detrimental impulse created at the upper end of the perforating gun due to the time delay in the detonation of the plurality of charges at the upper end perforating gun and the detonation of the plurality of charges at the bottom end of the perforating gun.

11. The apparatus of claim 10, wherein the jacket members include tilted jacket members having a orientation portion configured so that the charges positioned within the tilted jacket member are tilted to face downward relative to the vertical axis and are positioned proximate to the bottom end of the perforating gun.

12. A method for perforating a wellbore, comprising:
providing a gun housing having a plurality of charge receptacles formed therein;
determining a detrimental force resulting from detonating a plurality of shaped charges positioned in the gun housing within a wellbore;
selecting a jacket for each of the plurality of shaped charges configured to be received in the plurality of charge receptacles in a selected orientation relative to a vertical axis of the gun to provide a charge reaction force to counteract the detrimental force;
running the gun having plurality of explosive charges to a depth into the wellbore; and
detonating the plurality of explosive charges in the wellbore.

13. The method of claim 12, wherein the jacket members include tilted jacket members having a orientation portion configured so that the charges positioned within the tilted jacket member are tilted to face downward relative to the vertical axis of the perforating gun.

14. The method of claim 13, wherein the tilted charges are all oriented at the same non-perpendicular angle relative to the vertical axis.

15. The method of claim 13, further comprising:
selecting the reaction force to mitigate a detrimental impulse created at the upper end of the perforating gun due to the time delay in the detonation of the plurality of charges at the upper end perforating gun and the bottom end of the perforating gun; and
selecting the non-perpendicular angle of the tilted charges to create the selected reaction force.

16. The method of claim 15, wherein the tilted charges are positioned proximate to the bottom end of the perforating gun.

17. The method of claim 12, wherein the jacket members include straight jacket members having an orientation portion configured so that the charges positioned within the straight jacket member face perpendicular to the vertical axis of the perforating gun.

18. The method of claim 12, further comprising selecting the reaction force to mitigate a detrimental impulse created at the upper end of the perforating gun due to the time delay in the detonation of the plurality of charges at the upper end perforating gun and the bottom end of the perforating gun.

19. The method of claim 18, wherein the jacket members include tilted jacket members having a orientation portion configured so that the charges positioned within the tilted jacket member are tilted to face downward relative to the vertical axis of the perforating gun.

20. The method of claim 12, further comprising selecting the number of plurality of explosive charges to achieve the reaction force.

* * * * *